US005916256A

United States Patent [19]

Westerholm et al.

[11] Patent Number: 5,916,256

[45] Date of Patent: Jun. 29, 1999

[54] REFRIGERATING SYSTEM OF A REFRIGERATED FREIGHT CONTAINER

[75] Inventors: Göran Westerholm; Nils Larsson, both of Uppsala, Sweden

[73] Assignee: Frigotainer Insulated Air Cargo Containers AB, Knivsta, Sweden

[21] Appl. No.: 09/091,744

[22] PCT Filed: Dec. 23, 1996

[86] PCT No.: PCT/SE96/01746

§ 371 Date: Jun. 24, 1998

§ 102(e) Date: Jun. 24, 1998

[87] PCT Pub. No.: WO97/24567

PCT Pub. Date: Jul. 10, 1997

[30] Foreign Application Priority Data

Dec. 29, 1995 [SE] Sweden ..... 9600012

[51] Int. Cl.[6] ..... F25D 17/06

[52] U.S. Cl. ..... 62/406; 62/420

[58] Field of Search ..... 62/420, 423, 406, 62/371, 235.1, 239, 430

[56] References Cited

U.S. PATENT DOCUMENTS

| | | | |
|---|---|---|---|
| 1,299,175 | 4/1919 | Gruendler | 62/423 |
| 1,396,875 | 11/1921 | Pierce . | |
| 1,948,954 | 2/1934 | Weiland | 62/420 |
| 2,098,155 | 11/1937 | Minana et al. | 62/420 |

FOREIGN PATENT DOCUMENTS

| | | |
|---|---|---|
| 141566 | 6/1903 | Germany . |
| 259155 | 4/1913 | Germany . |
| 647488 | 7/1937 | Germany . |
| 716186 | 1/1942 | Germany . |

*Primary Examiner*—William Doerrler
*Attorney, Agent, or Firm*—Young & Thompson

[57] ABSTRACT

A refrigerating system of freight containers comprises an ice bin, against the wall of which the air to be refrigerated is caused to flow by way of a flow duct. At least one fan is provided for generating said flow and is thereby located above the lowermost level of the ice bin. At least a portion of the flow duct is formed by an interspace between a wall of the ice bin and a screen and between the screen and an insulated wall constitutuing an inner wall of the freight container and extending downwards from the fan or fans towards the lowermost level of the ice bin and then upwards past said wall of the ice bin.

12 Claims, 2 Drawing Sheets

REFRIGERATING SYSTEM OF A REFRIGERATED FREIGHT CONTAINER

Figure 1:
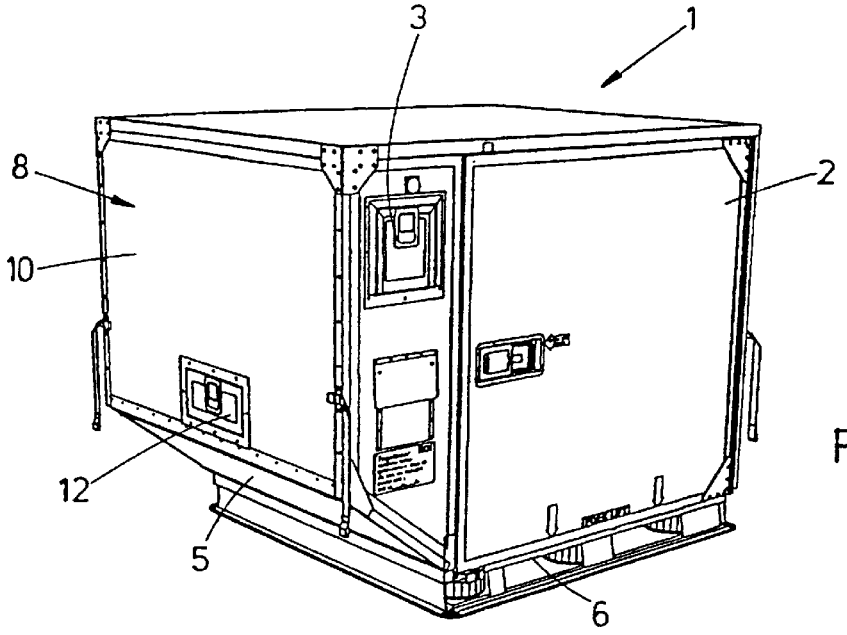

The present invention relates to freight containers intended for the transport of piece goods, and in particular to a freight container for the transport of frozen or refrigerated piece goods. Specifically, the invention relates a novel refrigerating system intended for such freight containers.

In order to maintain the temperature of frozen or refrigerated piece goods during air transport, insulated freight containers having some type of refrigerating equipment are used. Since electrically-driven refrigerating systems consume quite a lot of energy, and since there is a shortage of space inside the airplanes, thus making wiring complicated and making connecting and disconnecting the refrigerating systems troublesome, the use of such systems, for practical reasons, is avoided. There is also a risk of the power supply being disconnected and the refrigerating systems breaking down, in which cases the goods may be damaged or ruined. Further, such compressor-operated refrigerating and freezing systems are relatively heavy and expensive. It is primarily for these reasons, that the use of so-called carbon dioxide ice as refrigerating medium is preferred, the carbon dioxide ice, admittedly, having a limited operating time, which, however, is sufficient for the majority of applications, and under which it must not be exposed to any shutdowns.

The problems related to these freight containers involves obtaining a refrigerating-air flow that permits an even chill distribution around the piece goods in the freight containers, so that the desirable temperature of all of the piece goods therewithin will be maintained, and preventing the occurrence of self-flowing of the refrigerating air at a time when the fans are shut-off. In conventional containers, the guiding of the air streams through the load is performed in such a haphazard way, that the major portion of the refrigerating air in some cases will primarily flow closely along the wall, behind which the refrigerating medium is located. It may also occur, that the refrigerating air flows by itself in a direction, which is contrary to what is desirable, i.e. that the refrigerating air emerges by the floor, collecting thereon. In this case, local temperatures, which are as low as to damage the load, will be found.

Prior structures are provided with the refrigerating system itself, i.e. a box containing carbon dioxide ice, certain flow ducts around this box, and optional fan equipment, placed against a freight container wall adjacent to or directly against the freight container ceiling. In order to achieve an improved loading space, it is desirable to have the refrigerating system placed at a wall adjacent to the freight container floor. In freight containers of the type having a "cut-off" longitudinal corner, i.e. that a wall is broken at the bottom in its transition towards the floor in order to permit the placing of the freight container against an arcuate exterior wall of an airplane, it is desirable to place the refrigerating system in this corner. Such freight containers are conventional per se, regardless of the presence of the refrigerating system. Some advantages in loading would be obtainable, were it was possible to house a refrigerating system against this broken lower portion of the wall.

In freight containers of the type having a top-located refrigerating system, the ice bin, made from sheet metal, is surrounded by an interspace or duct chamber between the ice bin and a surrounding, insulated wall, which then partly is a portion of the freight container wall. In this interspace, the refrigerating air is caused to circulate, the ice bin wall serving as a transmission element between the circulating air and the chill within the ice bin. Carbon dioxide ice is placed in the ice bin through a lid located on the exterior side of the freight container, from which lid a short duct extends into the ice bin. This duct only occupies a relatively small portion of the refrigerating wall surface, across which the refrigerating air flows and, hence, does not substantially affect the refrigerating efficiency.

Upon placing of the refrigerating system at the bottom against the broken portion of the wall, and in view of the desirability of a system being as compact as possible, there will not be any space available to refrigerating ducts or refrigerating chambers extending around the entire ice box, such space, however, being available in case of a higher placement. In order to obtain an opening, which is sufficiently wide large to permit quick filling of ice into the ice box, and within given space, this lid will be long and low, so that this lid would also interfere with the flow surfaces to an extent, such that no flow about the entire ice box would be obtainable. In view of the above, it will be necessary to look for an entirely new solution with respect to the refrigerating system design.

The purpose of the present invention is to eliminate the problems mentioned above. This purpose is achieved through a refrigerating system as indicated in the patent claims, which also indicate the particular features of the invention.

Figure 2:
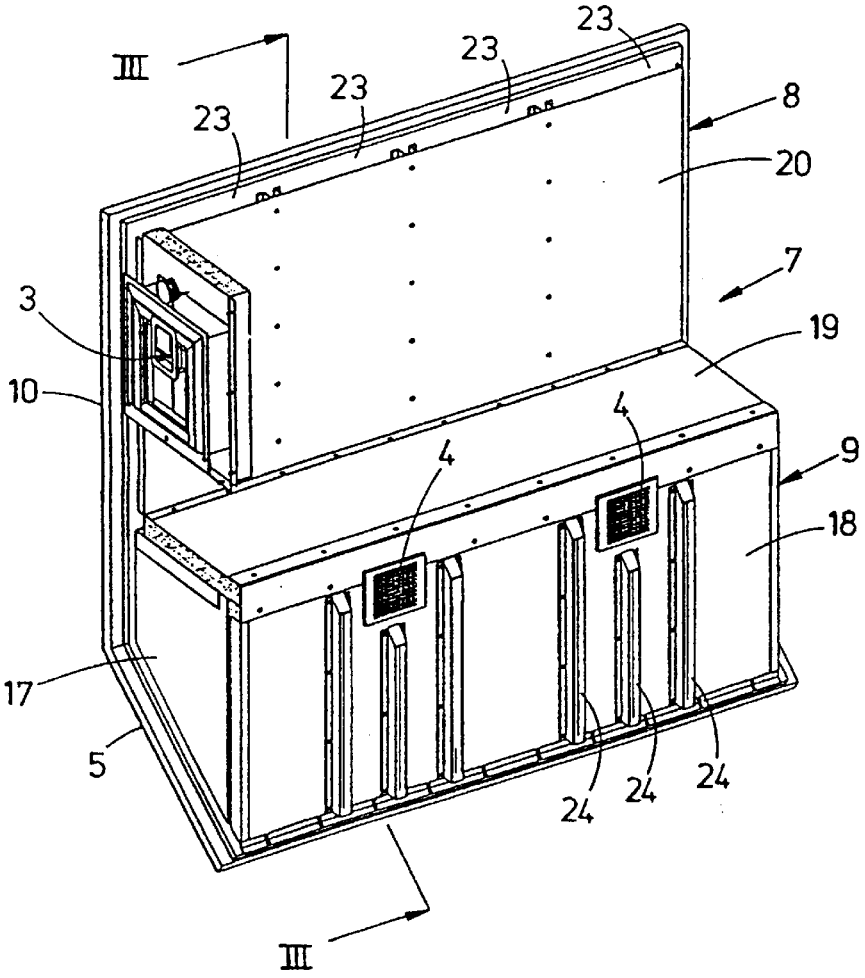
Figure 3:
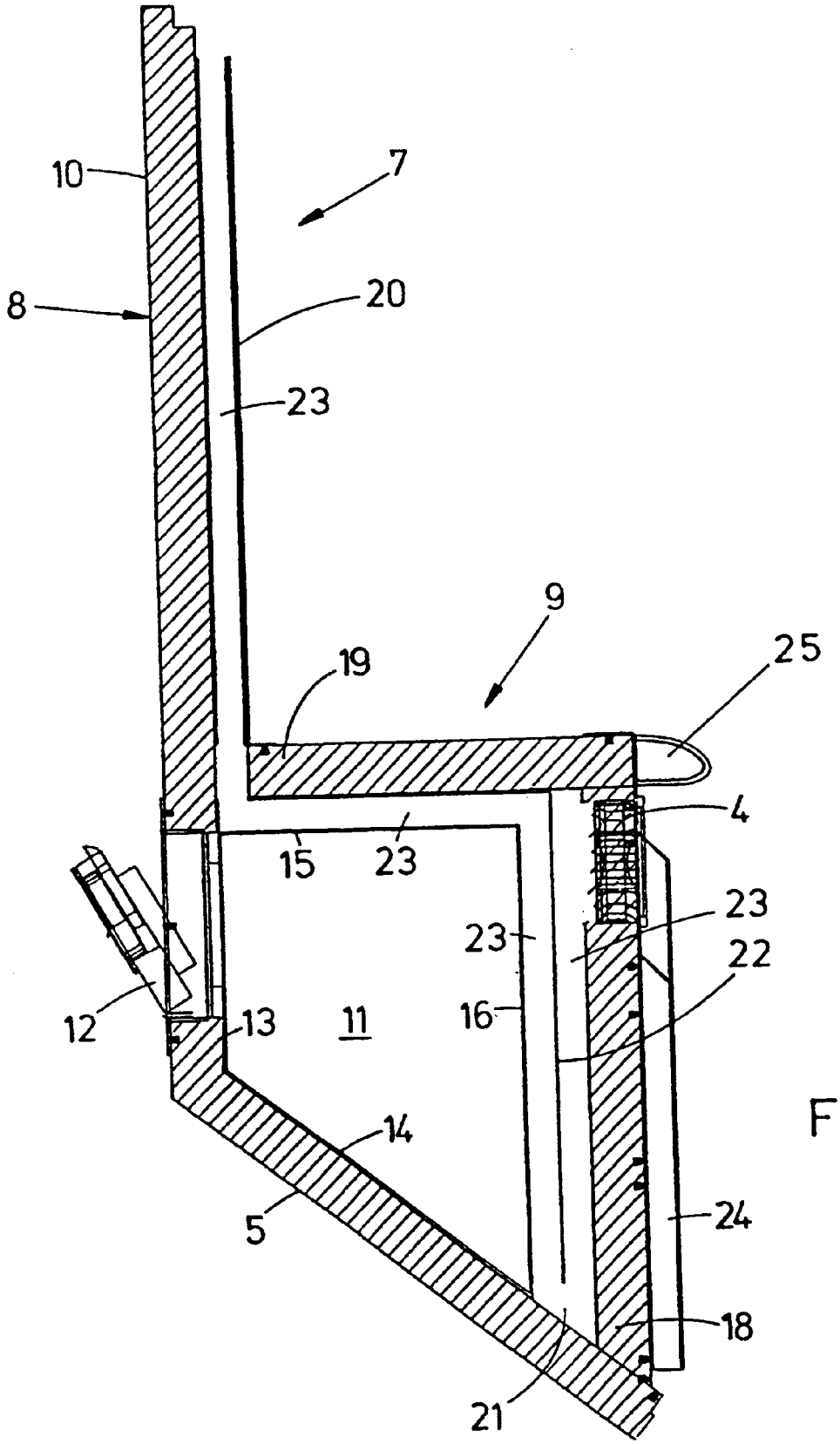

The invention will now be described in connection with the appended drawings, in which FIG. 1 is a perspective view of a freight container provided with a refrigerating system of the invention;

FIG. 2 is a broken-away perspective view, partly in cross-section, of the freight container portion of FIG. 1 comprising the invention; and FIG. 3 is a cross-section taken substantially along the plane III—III of FIG. 2.

In FIG. 1, there is shown an embodiment of a freight container 1 having a general conventional shape and comprising, in principle, a well-insulated box of a parallelepiped shape having a side door or lid 2, through which the load, normally piece goods, may be placed in the freight container 1 and removed therefrom. At the side of the door 2, a compartment having a lid 3 is provided, said compartment housing the refrigerating-air circulating equipment. It contains, among other things, the battery pack, which supplies power to refrigerating-air circulating fans 4 and to the thermostat arrangement (not shown) monitoring the temperature of the freight container 1 and serving to connect and disconnect the circulating fans 4.

Although the present invention primarily is intended for freight containers used in air transport of frozen or refrigerated piece goods, it will be appreciated that it may also be used together with other types of freight containers. The freight container 1 of FIG. 1 belongs to a type having a "cut-off" or broken longitudinal corner 5 at the bottom 6 of the freight container 1. Through this arrangement, the freight container may be placed on the bottom load deck of an airplane and relatively close to the arcuate exterior wall thereof. The invention will, however, be effective regardless of the shape of the corner and the further placement of the freight container. The freight container 1 is composed by separate elements, such that, i.e., each wall forms one unit, as well as ceiling, bottom etc, and these elements are thus easily replaced in the case of damage or other problems.

FIGS. 2 and 3 show the freight container element, which constitutes a wall 8 of the freight container 1 as well as comprises the refrigerating system 9. The wall 8 comprises a member 10, which is vertical in the normal orientation of the freight container 1, and a bottom member 5, which, as mentioned, is broken or inward deflected in the illustrated fashion. The wall 8 and the broken member 5, as well as the other walls, the floor and the of the freight container ceiling, comprise outer and inner panels, e.g. sheet aluminum, having intermediate insulation and being surrounded by an aluminum profile frame, all in a conventional fashion.

An ice box 11 of sheet aluminum or other suitable material is placed so as to abut against the broken member 5 and a small portion of the vertical wall member 10. The ice box 11 extends along the entire length or depth of the freight container 1. A lid 12 in the bottom portion of the vertical wall member 8 permits external filling of ice into the ice bin 11.

Since it is difficult to use the broken member 5 of the freight container for the rational loading of piece goods in the freight container 1, it makes sense to try to keep the refrigerating system as small as possible, and to thereby use the broken member 5 maximally. Thus, the ice bin itself has a shape, such that one of its walls, namely the exterior wall 13, connects to the bottom portion of the wall member 10 and the bottom 14 thereof connects to the broken member 5, while the upper wall 15 thereof extends substantially perpendicularly, away from the wall member 10 from a point directly above the upper edge of the lid 12, and the interior wall 16 thereof is parallel to the exterior wall 13. The end walls 17 of the ice bin 11 are parallel to the adjacent walls of the freight container 1 and provided with additional insulation to prevent chill from the ice within the ice bin 11 from dissipating into parts of the freight container, where it would not fill its purpose.

At the front edge of the broken member 5, at the freight container 1 bottom 6, as illustrated in FIG. 3, an insulated wall extends upwardly, in parallel with the wall member 10 to a height somewhat above the ice bin 11 wall 16, but with a distance thereto, and substantially at a right angle to the wall 18, an upper insulated wall 19 extends with a distance to the upper wall 15 of the ice bin away from this wall towards the freight container wall 8, but not all the way thereto. A pair of fans 4 are disposed in the wall 18 immediately below the location of the upper wall 19. A panel 20 extends from the upper wall 19 up towards the freight container 1 ceiling with a small distance to the wall 8.

In the interspace provided between the wall 16 of the ice bin 11 and the wall 18, a screen 22 is placed, said screen extending downwards and dividing the interspace 21, so that a duct 23 is formed beginning from the fans 4 and downwards towards the broken member 5 and around the lower edge of the screen and up between the ice bin wall 16 and the screen 22, further between the upper wall 15 of the ice bin and the insulated upper wall 19, and between the wall 8 and the panel 20 up towards the ceiling of the freight container 1. On the wall 18 side facing the interior of the freight container 1, vertical spacer elements are provided in the form of rails 24, said rails holding the piece goods clear from the wall 18, in particular at the fans 4. A horizontal sealing strip 25, made, i.e., from rubber, may be disposed above the fans 4, see FIG. 3.

The function of the invention is as follows:

In the starting situation, the bin 11 is filled with carbon dioxide ice having a temperature of about −78° C., and the freight container is then filled with refrigerated or frozen products. The thermostat inside the lid 3 is set to the temperature to be maintained within the freight container 1, and the condition of the batteries is checked, so that sufficient power will be available for the operation of the fans 4. When needed, the battery packs are replaced.

When the temperature within the freight container rises to the set value of the thermostat, the fans 4 will start, providing a refrigerating-air circulation. Thereby, the fans 4 sucks the air up from the floor area through the interspaces or flow ducts provided by means of the rails 24, since the rails 24 hold the goods clear from the wall 18. The sealing strip 25 projects sealingly against the piece goods, thereby preventing the air from being sucked into the fans 4 directly from above, as it closes the air passage from above. Then, the fans 4 push the air downwards through the duct 23 around the lower edge of the screen 22 and upwards, the air brushing the walls 16 and 15 of the ice bin and thereby becoming refrigerated, then passing up towards the ceiling in the interspace between the panel 20 and the wall 8. The air flows across the ceiling and is sucked down by way of the interstices provided between the goods and the surrounding walls, which normally will be provided with spacer elements corresponding to the spacer elements 24 and then will provide flow ducts for the refrigerating air. The goods is placed on some type of pallet on the floor, the pallet permitting air flow therethrough.

When the temperature has dropped to the set level, the fans 4 stop. In prior structures, where the fans are located at a low position in relation to the ice bin, and close thereto, it frequently occurs that the fans freeze, preventing them from restarting. It is also normal, that the refrigerating air flows out through the low position fans, thereby giving rise to air self-circulation, the air flowing out across the freight container bottom, where the temperature thereof increases and the air rises. Then, too, the fans will freeze because of the extremely cold air emanating from the ice. In the present invention, the fans 4 are located with such a distance to the ice bin 11, that the fan temperature will be the same as the temperature within the freight container 1, so that the fans will not freeze. Secondly, a lock against flow will be created by the screen 22 in the interspace 21, since the relatively heavy, refrigerating air will collect in the interspace 21, thus preventing self-circulation.

The present invention will thus provide a refrigerating system, primarily intended for air mode containers, said refrigerating system providing an even and reliable circulation and control of the refrigerating air in such freight containers, while the refrigerating system itself has been given a placement and size which, in many respects, are convenient.

What is claimed is:

1. A refrigerating system of freight containers (1) comprising an ice bin (11), against the wall (15, 16) of which the air to be refrigerated is caused to flow by way of a flow duct (23), and at least one fan (4) for generating the flow of the refrigerating air and located above the lowermost level of the ice bin (11), characterized by at least a portion of the flow duct (23) being formed by an interspace (21) located between a wall (16) of the ice bin (11) and a screen (22), and between the screen (22) and an insulated wall (18) constituting an inner wall of the freight container (1) and extending downwards from the fan or fans (4) towards the lowermost level of the ice bin (11) and then upwards past said wall (16) of the ice bin (16).

2. The refrigerating system of claim 1, characterized by the screen (22) extending downwards towards the bottom of the interspace (22), but at a distance thereto.

3. The refrigerating system of claim 1, characterized by the flow duct (23) being formed in part by an interspace between a panel (20) and the adjacent wall (8) of the freight container (1), said interspace terminating in the vicinity of the ceiling of the freight container (1).

4. The refrigerating system of claim 1, characterized by the fan or fans (4) being located in the insulated wall (18), and by the insulated wall (18) on the side facing the interior of the freight container (1) being provided with spacer elements (24, 25).

5. The refrigerating system of claim 4, characterized by one of the spacer elements being a strip (25) of resilient material and located substantially horizontally at the upper edge of the insulated wall (18).

6. The refrigerating system of claim 2, characterized by the flow duct (23) being formed in part by an interspace between a panel (20) and the adjacent wall (8) of the freight container (1), said interspace terminating in the vicinity of the ceiling of the freight container (1).

7. The refrigerating system of claim 2, characterized by the fan or fans (4) being located in the insulated wall (18), and by the insulated wall (18) on the side facing the interior of the freight container (1) being provided with spacer elements (24, 25).

8. The refrigerating system of claim 3, characterized by the fan or fans (4) being located in the insulated wall (18), and by the insulated wall (18) on the side facing the interior of the freight container (1) being provided with spacer elements (24, 25).

9. The refrigerating system of claim 6, characterized by the fan or fans (4) being located in the insulated wall (18), and by the insulated wall (18) on the side facing the interior of the freight container (1) being provided with spacer elements (24, 25).

10. The refrigerating system of claim 7, characterized by one of the spacer elements being a strip (25) of resilient material and located substantially horizontally at the upper edge of the insulated wall (18).

11. The refrigerating system of claim 8, characterized by one of the spacer elements being a strip (25) of resilient material and located substantially horizontally at the upper edge of the insulated wall (18).

12. The refrigerating system of claim 9, characterized by one of the spacer elements being a strip (25) of resilient material and located substantially horizontally at the upper edge of the insulated wall (18).

* * * * *